US007410227B2

(12) United States Patent
Liao

(10) Patent No.: US 7,410,227 B2
(45) Date of Patent: Aug. 12, 2008

(54) CABINET SAFETY DEVICE

(76) Inventor: Hui-Chen Liao, No. 14, Lane 155, Sec. 3, Hsi-Tun Rd., Taichung (TW)

( * ) Notice: Subject to any disclaimer, the term of this patent is extended or adjusted under 35 U.S.C. 154(b) by 463 days.

(21) Appl. No.: 11/184,145

(22) Filed: Jul. 19, 2005

(65) Prior Publication Data

US 2007/0018542 A1 Jan. 25, 2007

(51) Int. Cl.
*E05B 65/46* (2006.01)

(52) U.S. Cl. ..... 312/221

(58) Field of Classification Search ..... 312/215, 312/216, 217, 218, 219, 220, 221, 222, 107.5, 312/249.1, 249.8, 249.11; 70/79, 80, 81, 70/85

See application file for complete search history.

(56) References Cited

U.S. PATENT DOCUMENTS 4,478,466 A * 10/1984 Clark et al. ..... 312/215
5,862,689 A * 1/1999 Wen ..... 70/85
5,915,802 A * 6/1999 Siler ..... 312/216
7,264,319 B2 * 9/2007 Cheng ..... 312/220

* cited by examiner

*Primary Examiner*—James O Hansen
(74) *Attorney, Agent, or Firm*—William E. Pelton, Esq.; Cooper & Dunham LLP

(57) ABSTRACT

A cabinet safety device has a fixing base neighboring a side of the cabinet, a slide base mounted on the fixing base, lock members provided that can hook on both the slide base and the fixing base, and a fastening member provided between a bottom of the slide base and a bottom of the cabinet. When one of the drawers is pulled out, the slide base will go down to let the lock member escape from the slide base, and the slide base then goes up to prevent other drawers from sliding out, thus only one drawer can be pulled out at one time, which avoids potential danger when the center of gravity of the tool cabinet is shifted due to too many drawers being slid out at one time.

6 Claims, 13 Drawing Sheets

CABINET SAFETY DEVICE

BACKGROUND OF THE INVENTION

1. Field of the Invention

The present invention relates to a cabinet safety device, and particularly relates to a safety device being mounted on the cabinet to prevent the drawers from sliding out.

2. Description of Related Art

Generally, a conventional tool cabinet has several drawers mounted from the top down to store various tools and four wheels are mounted at the bottom of the cabinet, whereby the cabinet can be pushed conveniently, as shown in FIG. 13. In order to pull the drawers out more easily, rails are provided between the drawer and the cabinet. However, the drawers may slide out accidentally when the cabinet is moving, thus the tools may be scattered over a floor, and worse, the center of gravity of the tool cabinet might be shifted such that it tips over and endangers workers. Later, a locking device is provided to prevent the drawers from sliding out, but once the locking device is unlocked, all the drawers can be pulled out, whereby the center of gravity of the tool cabinet still might be shifted, resulting in danger to workers.

Therefore, the invention provides a cabinet safety device to mitigate or obviate the aforementioned problems.

SUMMARY OF THE INVENTION

The main objective of the present invention is to provide a cabinet safety device having a fixing base neighboring a side of the cabinet, a slide base mounted on the fixing base, lock members provided that can both hook on the slide base and the fixing base, and a fastening member provided between a bottom of the slide base and a bottom of the cabinet.

When one of the drawers is pulled out, the slide base will go down to let the lock member escape from the slide base, and the slide base then goes up to prevent other drawers from sliding out, thus only one drawer can be pulled out at one time, which eliminates the potential danger of prior art when more drawers slide out, leading to the center of gravity of the tool cabinet being shifted such that it tips over and endangers workers.

Other objectives, advantages and novel features of the invention will become more apparent from the following detailed description when taken in conjunction with the accompanying drawings.

BRIEF DESCRIPTION OF THE DRAWINGS

FIG. 12 is a perspective view of the fastening member when one of the drawers is pushed in.

DETAILED DESCRIPTION OF THE PREFERRED EMBODIMENT

Figure 1:
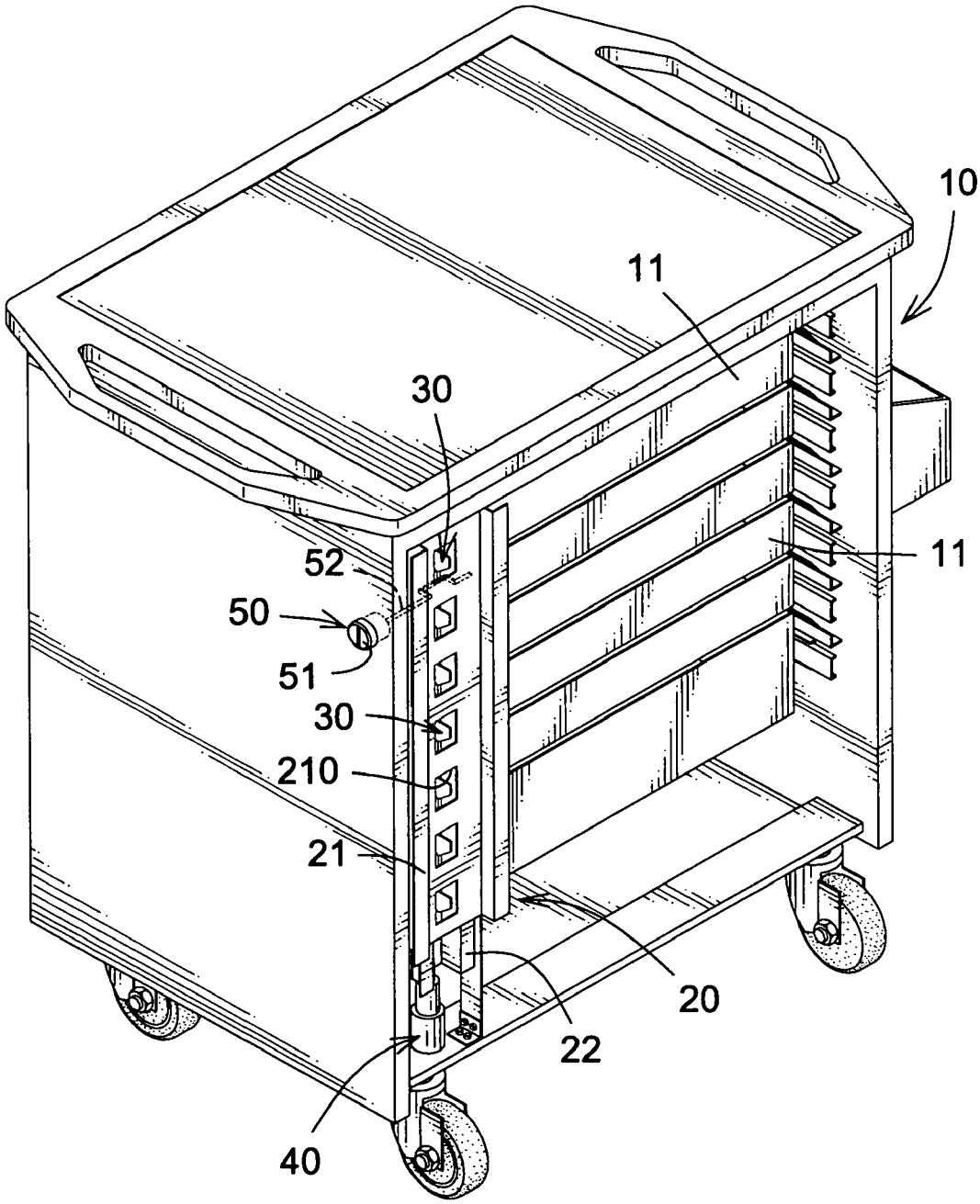
FIG. 1 is a rear view of a cabinet safety device in accordance with this invention.

With reference to FIG. 1, a tool cabinet (10) has several drawers (11) respectively mounted on a plurality of racks. At a backside of the cabinet (10), a safety device (20) is provided which has a fixing base (21) neighboring a side of the cabinet (10). A slide base (22) mounted on the fixing base (21) and the slide base (22) can go up and down along the fixing base (21). Multiple lock members (30) are provided that can both hook on the slide base (22) and the fixing base (21). A fastening member (40) is provided between a bottom of the slide base (22) and a bottom of the cabinet (10).

Figure 2:
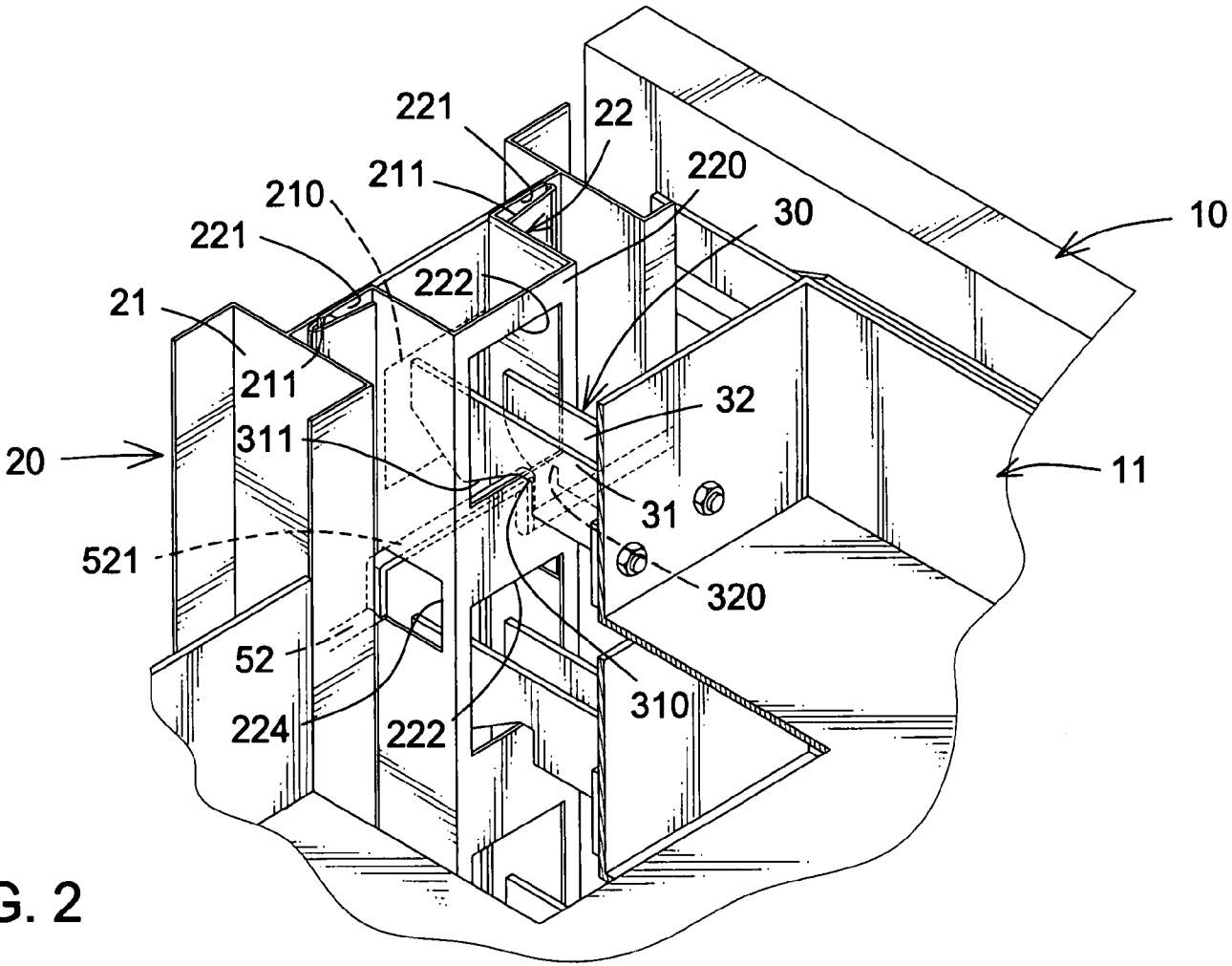
FIG. 2 is a partial perspective view of the cabinet safety device in accordance with this invention.

With reference to FIG. 1 and FIG. 2, multiple outer openings (210) are defined along the fixing base (21) from the top down, to allow extending out of lock members (30), and two sliding slots (211) are respectively defined at two sides of the outer opening (210), whereby the slide base (22) can go up and down along the sliding slots (211).

The slide base (22) is a metal case extending from a top to a bottom of the cabinet (10) including a U-shaped protruding member (220), and two distal ends of the protruding member (220) are respectively bent to form a rail (221), to insert in the sliding slots (211), thus the slide base (22) can go up and down along the fixing base (21). In addition, multiple inner openings (222) are defined in the protruding member (220) of the slide base (22) to retain the lock member (30).

Figure 3:
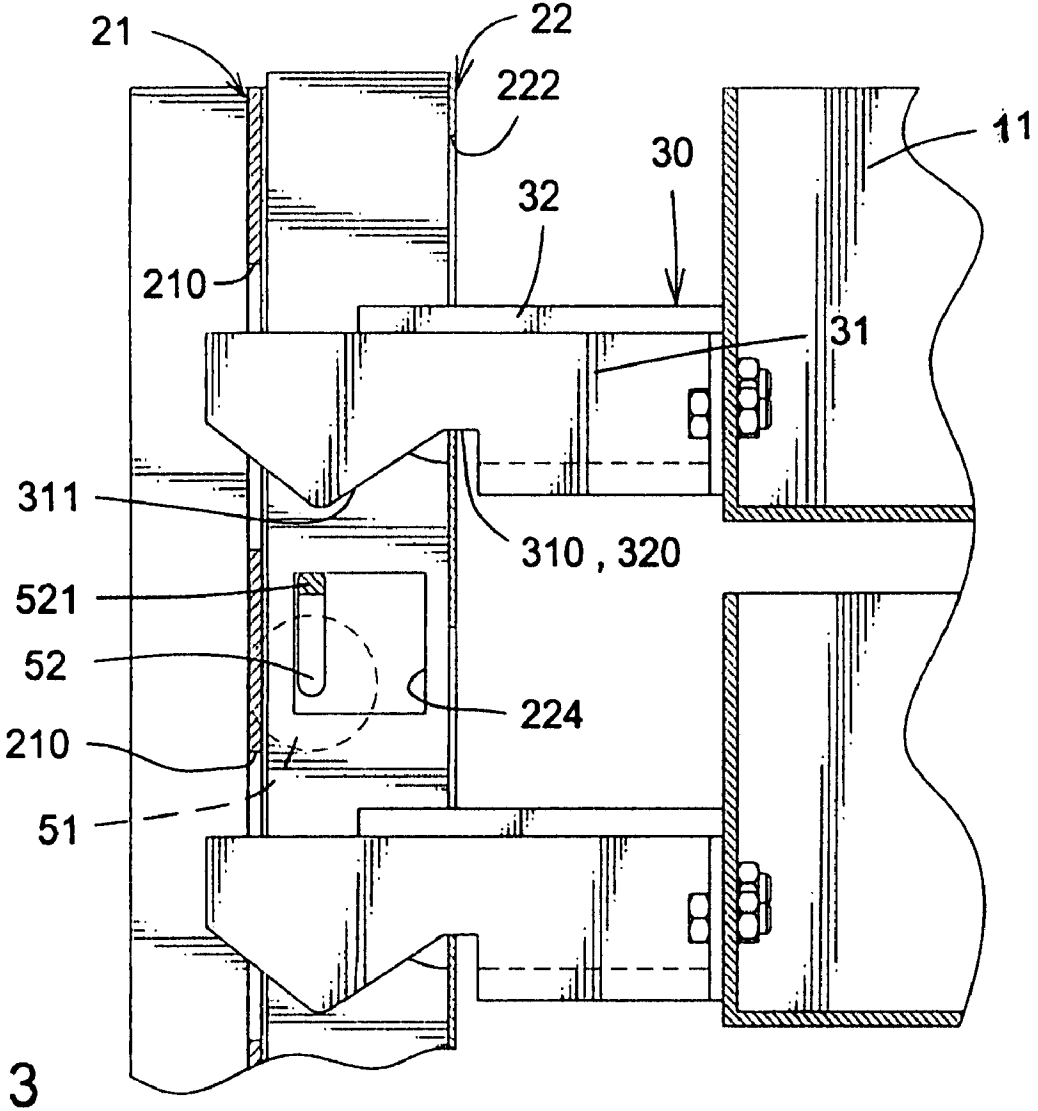
FIG. 3 is a sectional view of a locking device of the cabinet safety device in accordance with this invention.

Each lock member (30) has a first tongue (31) and a second tongue (32) both extending to the slide base (22). With further reference to FIG. 3, the first tongue (31) has a first groove (310), and the second tongue (32) has a second groove (320) respectively defined at bottom edges, meanwhile, a V-shaped chamfer (311) is formed at a distal end of the first tongue (31).

Figure 4:
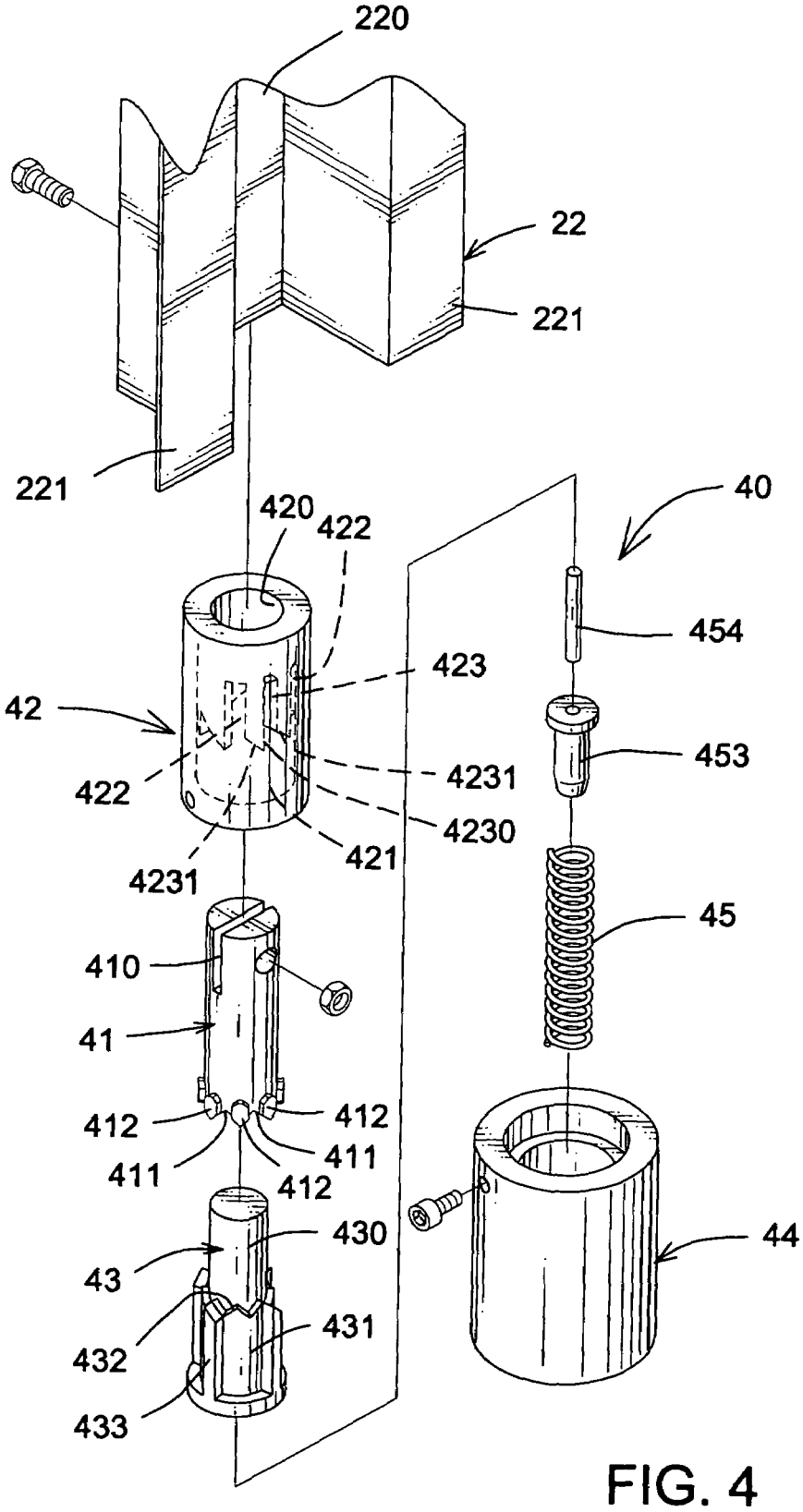
FIG. 4 is an exploded view of a fastening member of the cabinet safety device in accordance with this invention.
Figure 5:
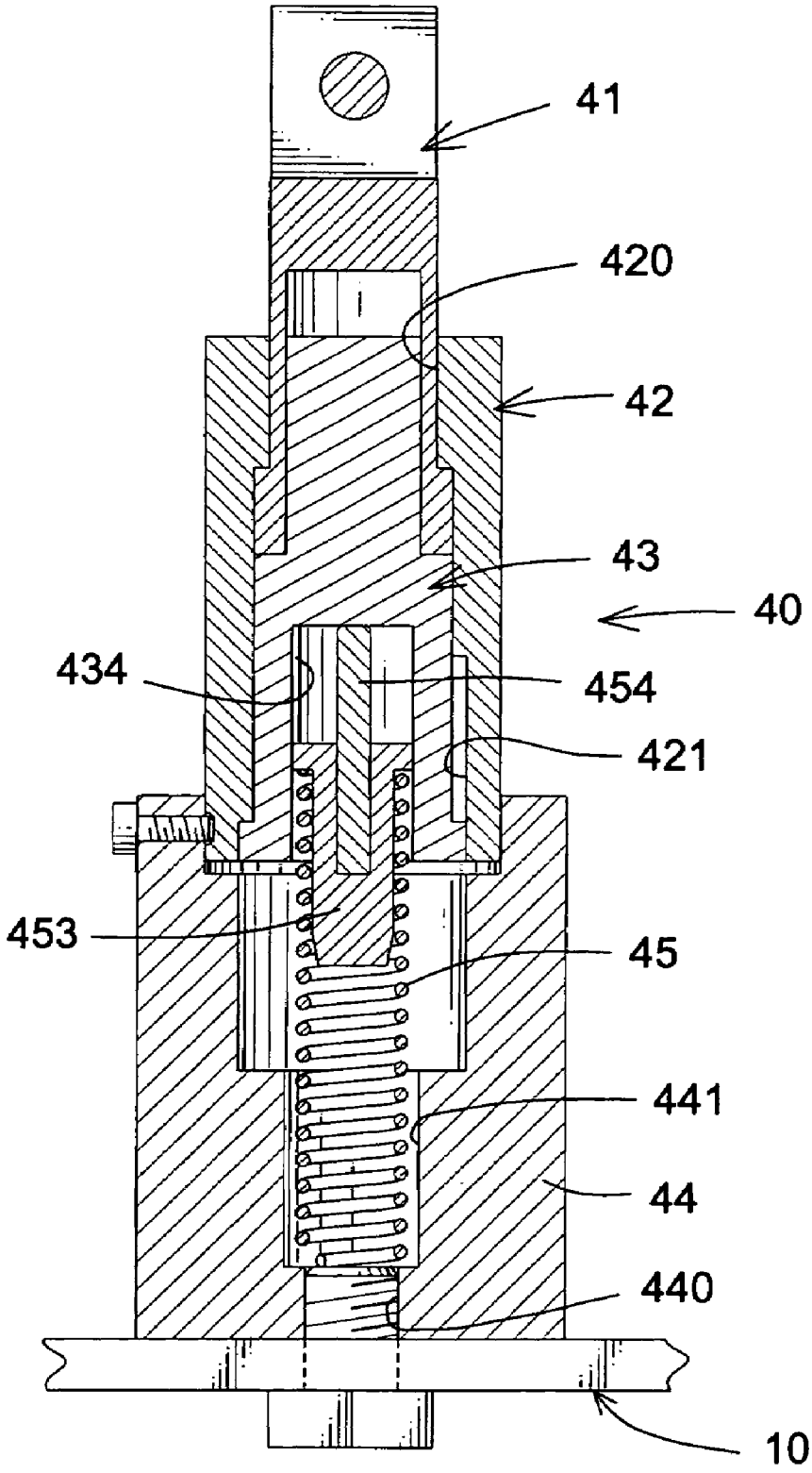
FIG. 5 is a sectional view of the fastening member of the cabinet safety device in accordance with this invention.
Figure 6:
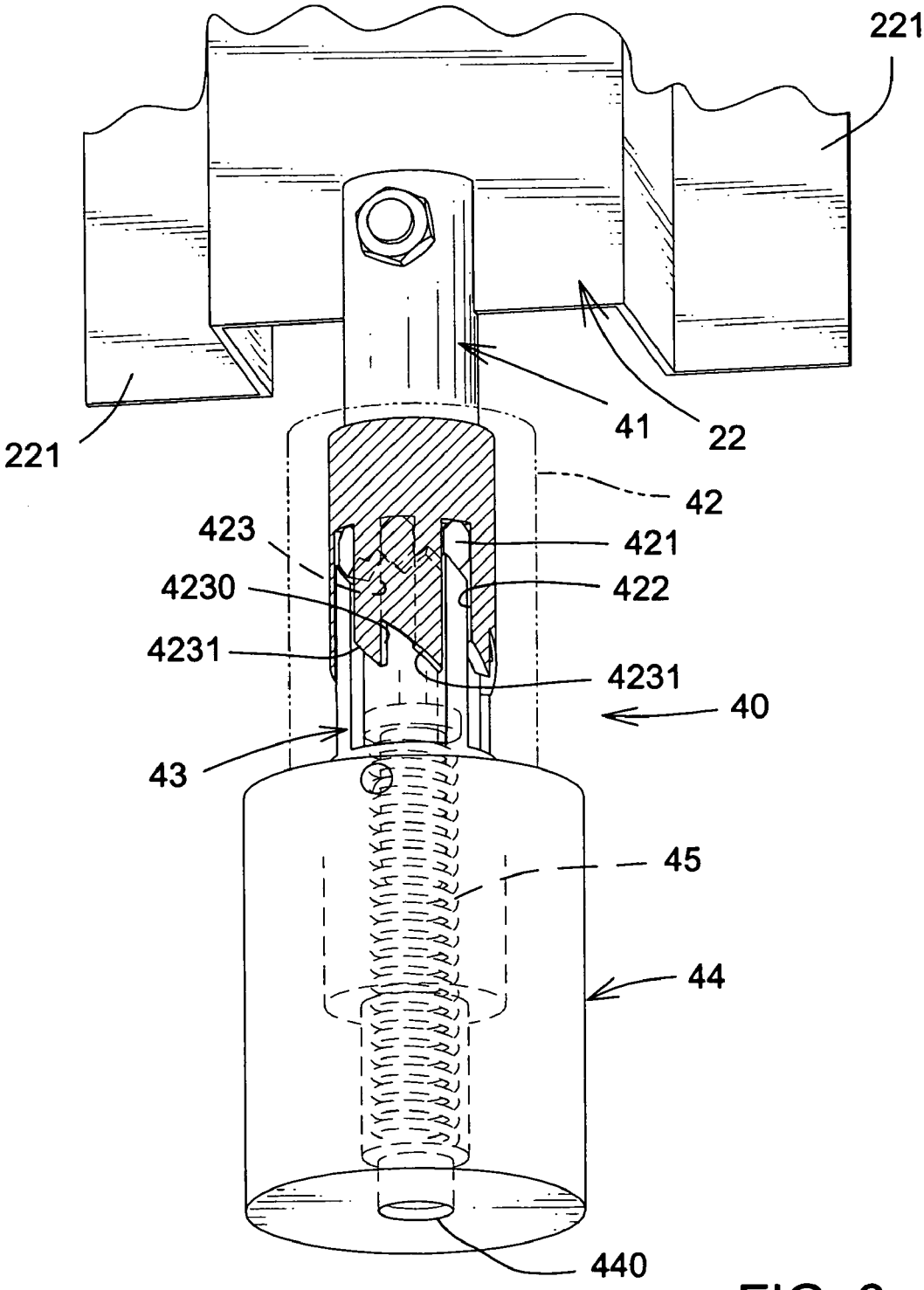
FIG. 6 is perspective view of the fastening member when the drawer is in a locking status.

With reference to FIGS. 4-6, the fastening member (40) has a piston (41) to support a bottom of the protruding member (220) of the slide base (22); a base pipe (44) in which the piston (41) is received; a resilient member (45) and a switch member secured between the base pipe (44) and the piston (41). In this embodiment, the switch member has a bushing (42), a rotating rod (43) mounted in the piston (41) and the bushing (42), and the base pipe (44) is mounted securely on the cabinet (10). The resilient member (45) is mounted in the base pipe (44) and the rotating rod (43). A through hole (420) is defined in the bushing (42), and the through hole (420) is extended to be a first cavity (421) that has a bigger diameter than the through hole (420). Multiple deep channels (422) are defined axially in an inner wall of the through hole (420) and the first cavity (421). Between every two adjacent deep channels (422), multiple shallow channels (423) are defined axially in the inner wall of the through hole (420) and the first cavity (421). The deep channel (422) and the shallow channel (423) have the same axial depth, but a radial depth of the shallow channel (423) is smaller than that of the deep channel (422), and a radial bottom of the shallow channel (423) is not as deep as that of the first cavity (421), so a radial depth difference is formed between the shallow channel (423) and the first cavity (421).

In each root edge of the deep channel (422) and the shallow channel (423), a chamfer is defined. Every chamfer has a vertical edge (4230), and a bevel edge (4231). The vertical edges (4230) are all located in the same side edge of the deep channel (422) and the shallow channel (423). The piston (41) can go up and down cooperating with the deep channel (422) and the shallow channel (423), and the rotating rod (43) rotates along the multiple chamfers.

The piston (41) has a recess (410) defined in a top end, and the top end goes through the first cavity (421), and the through hole (420), then the recess (410) clamps the protruding member (220) of the slide base (22). Multiple tips (412) are formed at a bottom of the piston (41), and the tips (412) are respectively accommodated in the deep channels (422) and the shallow channels (423). Multiple piston tooth members (411) are formed at the bottom of the piston (41) for pushing the rotating rod (43).

The rotating rod (43) has a spindle (430), and a driven member (431) is formed at a lower part of the spindle (430). Multiple rod tooth members (432) are formed at a top of the driven member (431) and are engaged with the piston tooth members (411). In addition, multiple prominent portions (433) are formed on a surface of the driven member (431) and are all received in the deep channel (422) or all received in the shallow channel (423). At the bottom of the rotating rod (431), a depression (434) is defined to receive a top of the resilient member (45), and a bottom of the resilient member (45) is received in the base pipe (44).

A connecting hole (440) is defined in a bottom of the base pipe (44), through which the resilient member (45) can be fixed at the cabinet (10). A second cavity (441) is defined in the base pipe (44) to secure the resilient member (45), whereby the resilient member (45) is compressed between the base pipe (44) and the rotating rod (43). In this embodiment, the resilient member (45) is a spring. To reduce a contact area of the spring and the rotating rod (43), a brace pole (453) with a bolt (454) is mounted on the top of the spring.

A locking device (50) is mounted beside the cabinet (10). The locking device (50) includes a lock end (51), and a locking pole (52). With reference to FIG. 2 and FIG. 3, the locking pole (52) with a bracing member (521) is extended through two opposed side openings (224) defined in the slide base (22). When the locking pole (52) is driven to rotate, the bracing member (521) contacts and holds an upper edge of the side opening (224) and the slide base (22) is held upward. An edge of the inner opening (222) is closely received in the second groove (320), and the corresponding drawer (11) cannot be pulled out, which prevents unauthorized access, and the drawer (11) will not slide out when moving.

Figure 7:
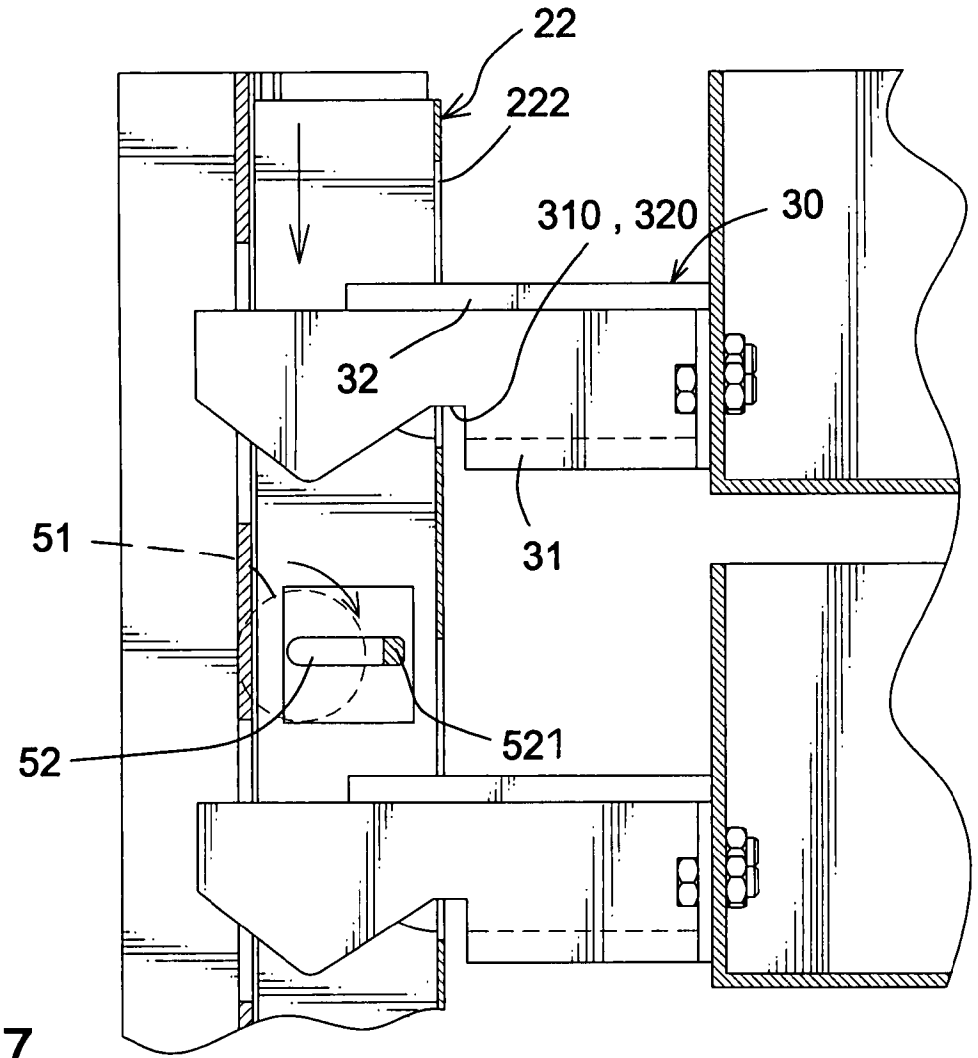
FIG. 7 is a sectional view of the locking members and the locking device in a status that any single drawer can be pulled out at one time.

With reference to FIG. 7, when it is necessary to pull one of the drawers (11), the lock end (51) direction is changed by a key and the bracing member (521) is turned to another direction, at this moment, the slide base (22) descends due to its weight, all the bottom edge of the second slot (222) will escape from the second tongue (32) and be located below the second groove (320), and the slide base (22) is in a free status. Thus, the user can pull out any one of the drawers (11).

Figure 9:
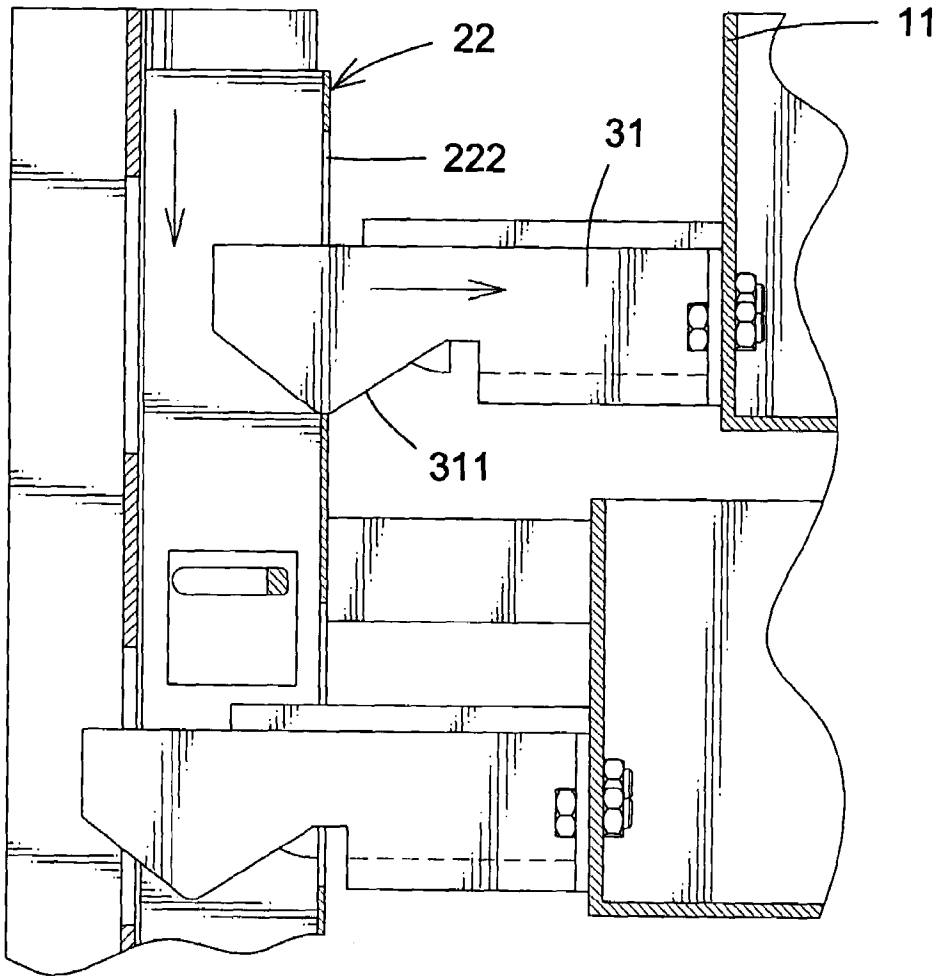
FIG. 9 is a sectional view showing a V-shaped chamfer pushing the slide base down when one drawer is pulled out.
Figure 10:
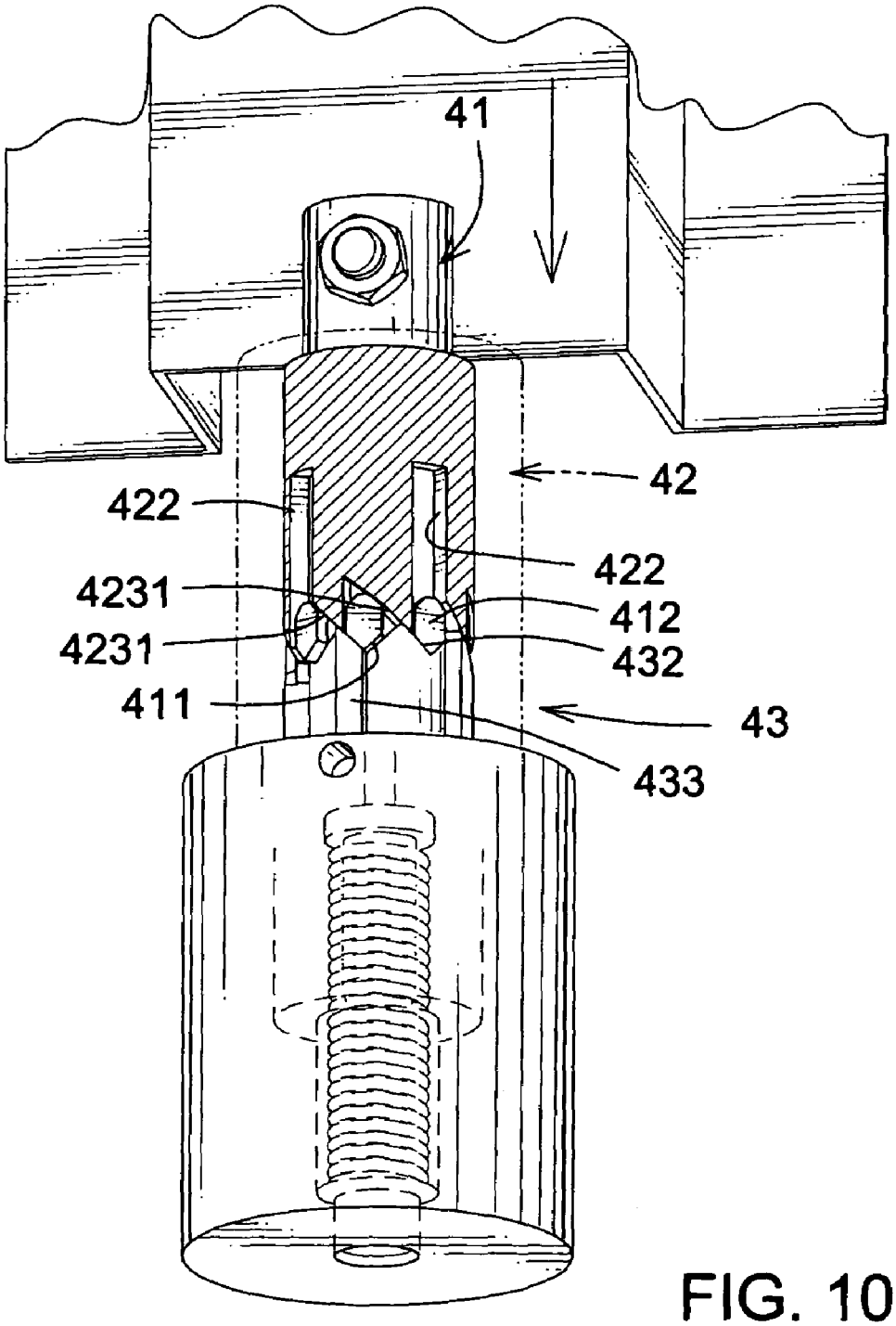
FIG. 10 is perspective view of the fastening members in a status as in FIG. 9.

With reference to FIG. 9, when one of the drawers (11) is pulled out, the V-shaped chamfer (311) pushes the bottom edge of the second slot (222), leading to the descent of the slide base (22) as well as the piston (41) as shown in FIG. 10, and the rotating rod (43) goes down, too. When a lowest point of the V-shaped chamfer (311) contacts with the bottom edge of the second slot (222), one edge of the piston tooth members (411) is in a same line with the bevel edge (4231) of the bushing (42), thus the rotating rod (43) is rotated to make the prominent portion (433) below and partially engage the bevel edge (4231) of the deep channel (422).

Figure 11:
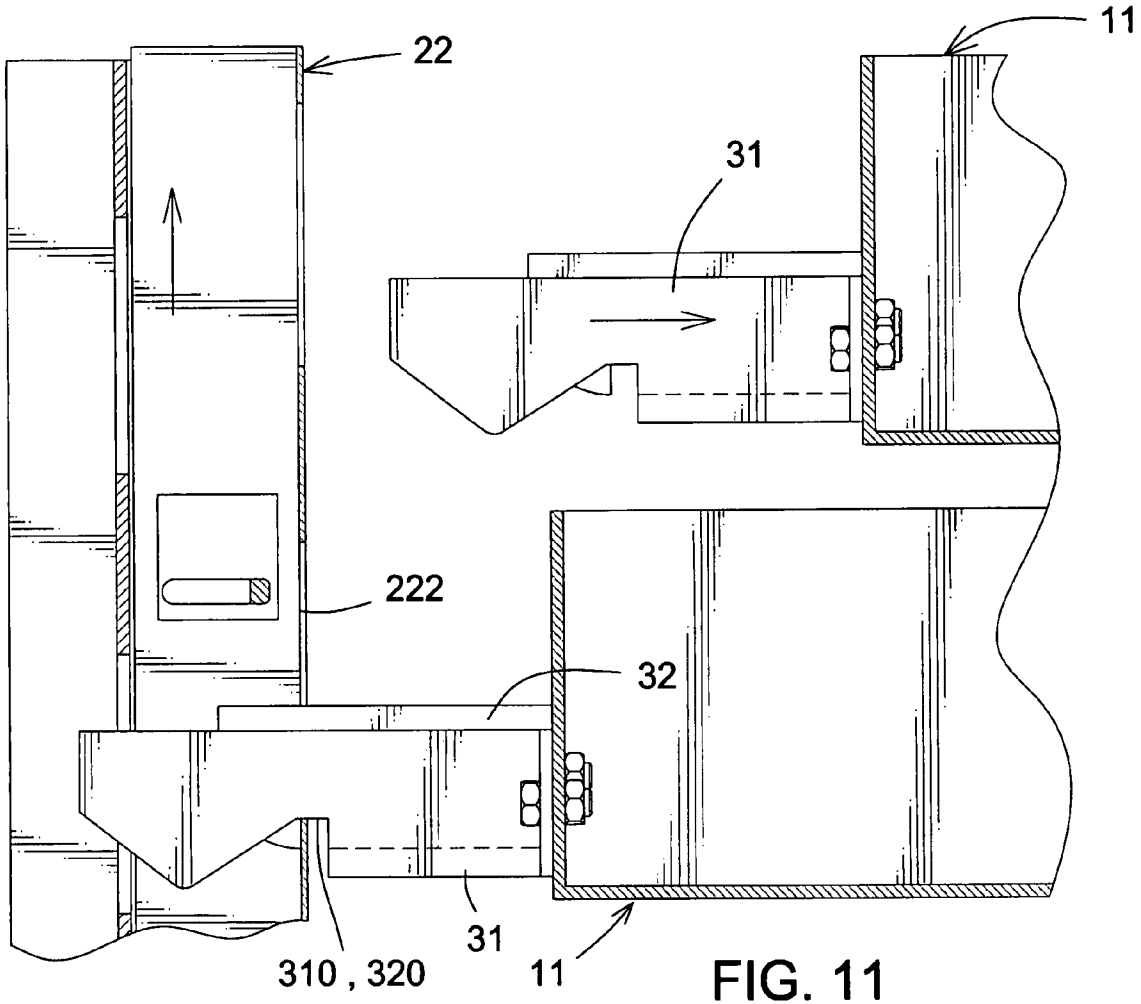
FIG. 11 is sectional view when one of the drawers fully escapes from the slide base.

When the drawer (11) is further pulled out as shown in FIG. 11, the first tongue (31) escapes from the slide base (22), and the rotating rod (43) rises along the bevel edge (4231) due to the resilient member (45), as shown in FIG. 6, whereby the prominent portion (433) is respectively secured in the deep channel (422), and further the tip (412), the piston (41) and slide base (22) are pushed upward. The bottom edge of the second slot (222) is received in the first groove (310) and a second groove (320), thus other drawers cannot be pulled out.

Figure 8:
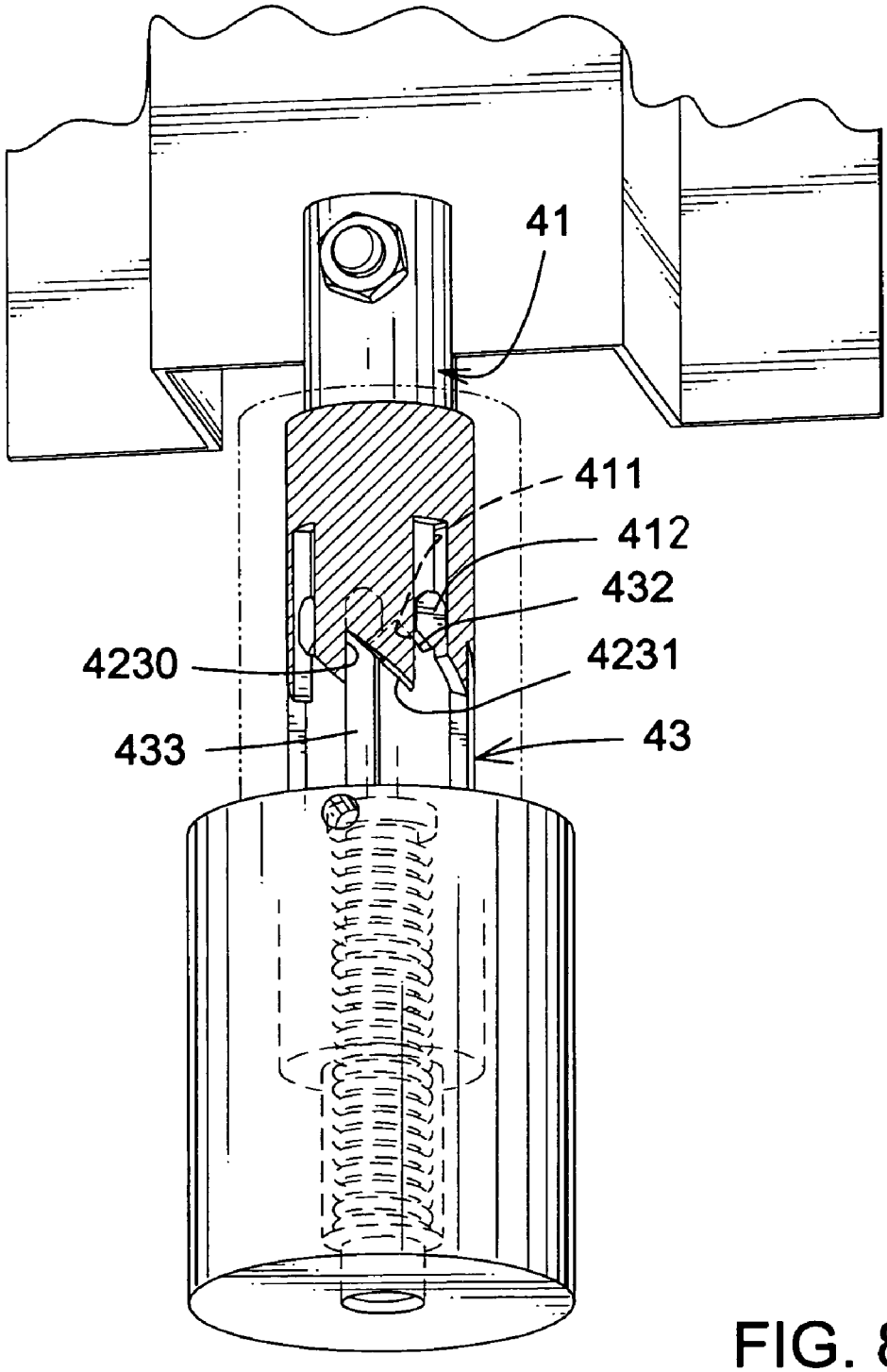
FIG. 8 is a perspective view of the fastening member in a status when any single drawer can be pulled out at one time.
Figure 12:
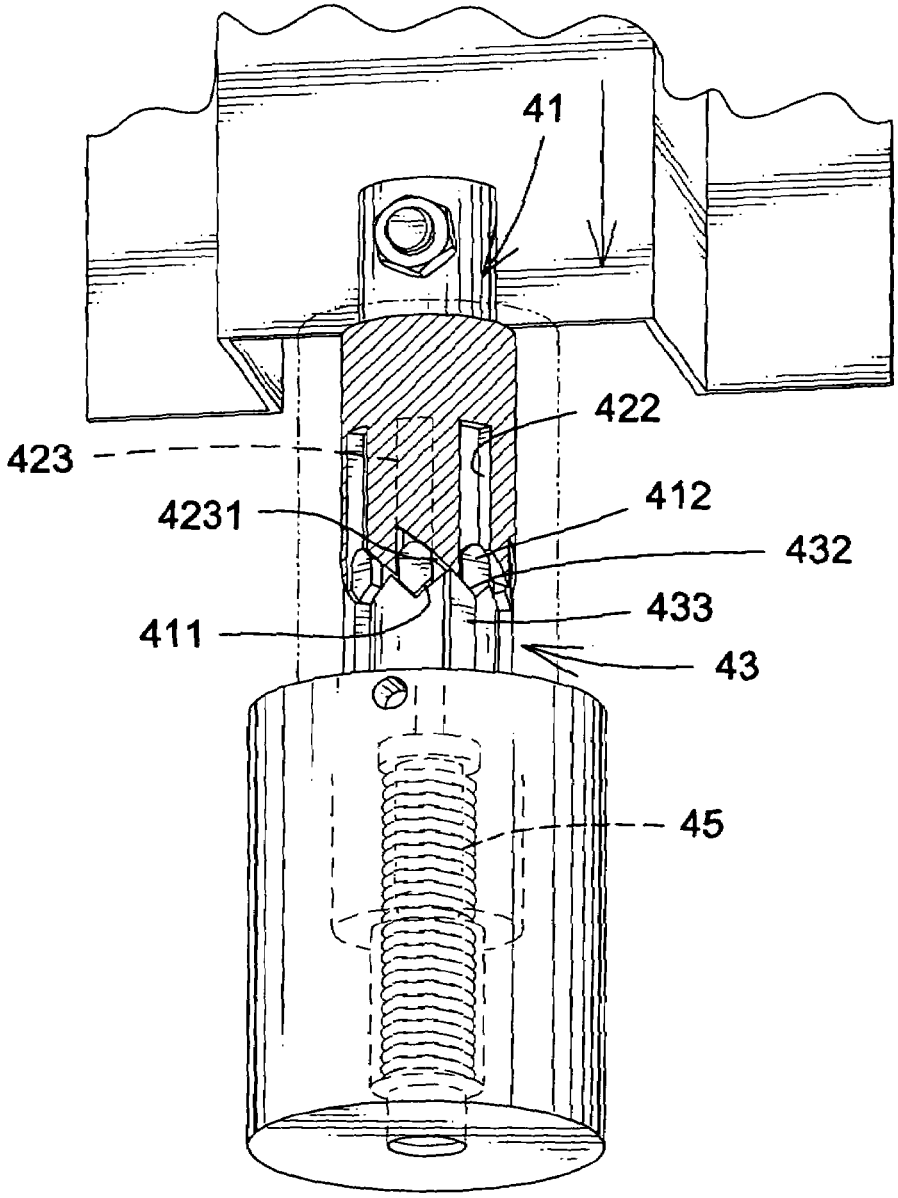
Figure 13:
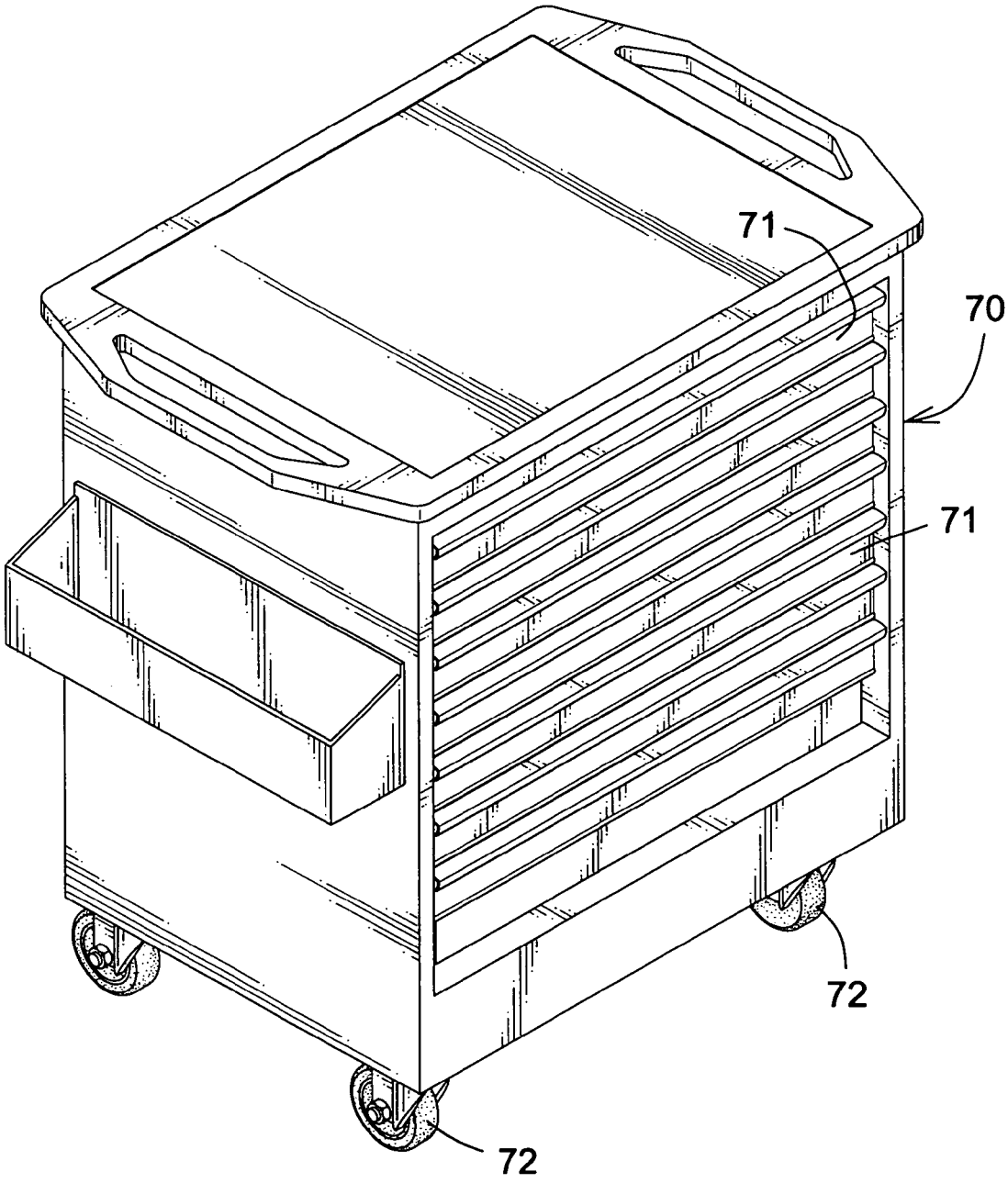
FIG. 13 PRIOR ART
FIG. 13 is perspective view of a conventional cabinet.

If one of the other drawers (11) is to be pulled out, the drawer (11) previously pulled out must first be pushed in, and the V-shaped chamfer (311) of the first tongue (31) pushes the slide base (22) downward, then the tip (412) pushes the rotating rod (43) to let the prominent portion (433) descend below the leading edge (4231) of the shallow channel (423), as shown in FIG. 12. When the drawer (11) is fully closed, the prominent portion (433) is secured in the shallow channel (423), as shown in FIG. 8, then the slide base (22) comes to the original status, such than any single drawer (11) can be opened at that time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cabinet safety device comprising:

a fixing base;

a slide base mounted on the fixing base extending from a top to a bottom of a cabinet including a U-shaped protruding member, wherein multiple inner openings are defined in the protruding member of the slide base;

a lock member having a first tongue with a first groove, and a V-shaped chamfer formed at a distal end of the first tongue; and a fastening member having a base pipe mounted securely on the cabinet; a piston received in the base pipe with multiple tips formed at a bottom of the piston; a resilient member and a switch member secured between the base pipe and the piston, wherein the switch member has a bushing with a through hole defined in the bushing and the through hole is extended to define a first cavity that has a bigger diameter than a diameter of the through hole; multiple deep channels defined axially in an inner wall of the through hole and the first cavity and between every two adjacent deep channels; multiple shallow channels defined axially in the inner wall of the through hole and the first cavity, wherein the deep channels and the shallow channels have a same axial depth, but a radial depth of the shallow channels is smaller than a radial depth of the deep channels and a radial bottom of the shallow channels is not as deep as that of the first cavity; a rotating rod mounted in the piston and the bushing with a spindle and a driven member formed at a lower part of the spindle, the resilient member being mounted between the base pipe and the rotating rod; a rod tooth member is formed at a top of the driven member, which is engaged with a piston tooth member that is formed at the bottom of the piston; and a surface of the driven member has multiple prominent portions formed thereon and are all received in the deep channels or all received in the shallow channels.

2. The cabinet safety device as claimed in claim 1 wherein the resilient member is a spring with a bolt mounted therethrough.

3. The cabinet safety device as claimed in claim 2 wherein a brace pole with the bolt of the spring is mounted on the top of the spring.

4. The cabinet safety device as claimed in claim 1 wherein the lock member includes a second tongue having a second groove defined at a bottom edge.

5. The cabinet safety device as claimed in claim 4 wherein a locking device mounted beside the cabinet includes a lock end, a locking pole, and the locking pole with a bracing member is extended through two opposed side openings defined in the slide base.

6. The cabinet safety device as claimed in claim 1 wherein a locking device mounted beside the cabinet includes a lock end, a locking pole, and the locking pole with a bracing member is extended through two opposed side openings defined in the slide base.

* * * * *